US007503844B1

(12) United States Patent
Vidler, Jr.

(10) Patent No.: US 7,503,844 B1
(45) Date of Patent: Mar. 17, 2009

(54) METHODS OF RETROFITTING A VENTILATION ASSEMBLY USED IN SECURITY SETTINGS AND APPARATUS

(75) Inventor: Richard J. Vidler, Jr., Buxton, OR (US)

(73) Assignee: Washington County, Hillsboro, OR (US)

( * ) Notice: Subject to any disclaimer, the term of this patent is extended or adjusted under 35 U.S.C. 154(b) by 0 days.

(21) Appl. No.: 11/433,202

(22) Filed: May 11, 2006

Related U.S. Application Data

(60) Provisional application No. 60/680,202, filed on May 11, 2005.

(51) Int. Cl.
*F24F 7/00* (2006.01)

(52) U.S. Cl. ..... 454/316

(58) Field of Classification Search ..... 454/292, 454/296, 321, 330, 331, 316
See application file for complete search history.

(56) References Cited

U.S. PATENT DOCUMENTS 2,995,079 A * 8/1961 La Fontaine ..... 454/292
5,205,784 A 4/1993 DeHart et al.
5,375,373 A 12/1994 Tiede
5,401,133 A * 3/1995 Kuchler ..... 411/402
5,968,216 A 10/1999 Powell et al.
5,976,007 A 11/1999 Powell et al.
6,113,488 A * 9/2000 Tiede ..... 454/276
6,149,514 A * 11/2000 Maury ..... 454/276
6,371,846 B1 * 4/2002 Powell et al. ..... 454/271
6,425,821 B1 * 7/2002 Koerber et al. ..... 454/296
RE38,121 E 5/2003 Powell et al.
6,574,932 B2 6/2003 Layne et al.
6,604,994 B2 * 8/2003 Achen ..... 454/271

OTHER PUBLICATIONS

Cell Security Limited, "CS54 Anti-Ligature Ventilation Grille," www.cellsecurity.co.uk/vents/cs54.htm (Printed May 11, 2006).
Safety Concepts, "The S-Vent," www.safetyconcepts.com (Printed May 11, 2006).

* cited by examiner

*Primary Examiner*—Steven B McAllister
*Assistant Examiner*—Samantha A Miller
(74) *Attorney, Agent, or Firm*—Klarquist Sparkman, LLP

(57) ABSTRACT

A retrofit grille frame for retrofitting an existing ventilation assembly used in security settings comprises a frame having an outer periphery sized larger than an opening for the existing ventilation assembly. The frame has at least one inner edge defining a vent opening in the frame. The vent opening is free of any projection of substantial length extending inwardly from any inner edge. The frame has a grille member receiving portion defined on an inner side for receiving a grille member and retaining the grille member in place when the frame is installed and at least one attachment portion capable of receiving a fastener for attaching the frame and a grille member to the existing ventilation assembly.

21 Claims, 4 Drawing Sheets

METHODS OF RETROFITTING A VENTILATION ASSEMBLY USED IN SECURITY SETTINGS AND APPARATUS

CROSS REFERENCE TO RELATED APPLICATION

This application claims the benefit of U.S. Provisional Patent Application No. 60/680,202, filed May 11, 2005, which is hereby incorporated by reference.

FIELD

This application relates to ventilation systems, and in particular to methods and apparatus for retrofitting ventilation assemblies used in security settings, such as jail cells, prison cells, mental health facilities, etc., to reduce death and injury from hangings and damage to the systems.

BACKGROUND

Conventional ventilation assemblies used in security settings typically have at least one grille (or grate) secured in place on a surface (such as, e.g., a wall or a ceiling) of the cell or other enclosed area where the occupant is being confined. The grille has openings to allow air in the cell to be exchanged, such as through ductwork connected as part of a ventilation system for the facility.

In conventional assemblies, the grilles often have a reinforced construction in an effort to prevent the occupant from accessing an area outside the cell, such as in an attempt to escape from the cell. These conventional grille and grille frame constructions, however, may allow occupants to hang themselves or be hanged.

Others have attempted to address this problem, such as by providing a grille with air passages that have substantial direction changes that make it difficult to thread through a rope or a belt. The passages in these grilles, however, increase the restriction to air flow and thus may be undesirable. Also, the prior approaches do not address the need to quickly and cost-effectively retrofit a large installed base of existing conventional ventilation assemblies.

SUMMARY

Described below are methods for retrofitting conventional ventilation assemblies to reduce the chance that a cell occupant can hang himself or be hanged. Also described are a new grille and new grille frame for use with conventional assemblies, such as after modification. The new methods and apparatus significantly reduce the likelihood that the ventilation assembly can be used to suspend body weight, yet provide ample ventilation air flow and also prevent objects from being inserted into the ventilation system.

According to a representative method of retrofitting a ventilation assembly used in security settings, an existing ventilation assembly having an existing outer frame in which an inner venting area is defined is provided. The existing outer frame has at least one outer cross member spanning the venting area, an inner frame in which an inner venting area is defined and having at least one inner cross member, and a grille member positioned between the outer frame and the inner frame and generally aligned with each respective venting area. The method includes removing the outer cross member of the existing outer frame, thereby providing access to the grille member, removing the existing grille member to provide access to the inner frame and inner cross member and removing a portion of the inner cross member. The method also includes providing a replacement outer frame that defines an open inner venting area substantially free of obstructions and providing a replacement grille member. Further, the method includes attaching the replacement outer frame to the inner frame and over a remaining portion of the existing outer frame with the replacement grille member positioned between the replacement outer frame and the inner frame.

The method can include removing the at least one outer cross member by cutting the outer cross member at each end substantially flush with an adjacent inner edge(s) of the outer frame. The outer cross member can include a first cross member and a second cross member arranged to intersect each other and to divide the inner venting area into four open portions.

The method can include providing a replacement grille member of a same type as the existing grille member. The method can include providing a replacement grille member having a wire mesh construction with a mean pore size less than about 5 mm. The method can include providing a replacement grille member made of a stainless steel material.

In the methods, the acts of removing the at least one outer cross member and removing at least a portion of the inner cross member can be carried out without removing the existing outer frame or the inner frame from the surrounding surface to which they are mounted.

Removing a portion of the inner cross member can include cutting the inner cross member at each end at a distance spaced from an adjacent inner edge(s) of the inner frame, thereby defining respective remainder portions of the inner cross member.

Attaching the replacement outer frame to the inner frame can include connecting the replacement outer frame to the remainder portions of the inner cross member. The method can include providing holes in the remainder portions of the inner cross member, the holes being configured to receive fasteners for connecting the replacement outer frame to the inner frame.

The method can include attaching the replacement outer frame to the inner frame by connecting the replacement outer frame to the inner frame with tamper-resistant fasteners.

Providing a replacement outer frame that defines an open inner venting area substantially free of obstructions can include providing a replacement outer frame free of any projection of substantial length extending from an inner edge.

A retrofit grille frame for retrofitting an existing ventilation assembly used in security settings can include a frame having an outer periphery sized larger than an opening for the existing ventilation assembly. The frame can have at least one inner edge defining a vent opening in the frame, with the vent opening being free of any projection of substantial length extending inwardly from any inner edge. The frame can have a grille member receiving portion defined on an inner side for receiving a grille member and retaining the grille member in place when the frame is installed. The frame can have at least one attachment portion capable of receiving a fastener for attaching the frame and a grille member to the existing ventilation assembly.

The frame can have four inner edges defining a generally rectangular vent opening and four attachment portions, each of the attachment portions being spaced approximately midway along a respective one of the inner edges and extending inwardly. The frame can have a grille member made of a mesh laminate material. The grille member can be made of a sintered mesh laminate material and sized to fit within the grille receiving area of the frame but larger than the vent opening such that when the frame and grille member are installed on the existing ventilation assembly, the grille member is retained in place by the frame.

The grille member can be made of a mesh laminate material having a mean pore size of less than about 5 mm. The grille member can be made of a mesh laminate material having a mean pore size of less than about 2 mm. The grille member can be made of a mesh laminate material having a mean pore size of about 1 mm.

The attachment portion can include an aperture, and there can be at least one fastener having a tamper resistant head portion and configured to extend through the aperture in the attachment portion and a corresponding aperture in a grille member, the fastener having a remaining length sufficient to allow attachment to the existing ventilation assembly and to accommodate at least one washer to achieve a tight fit of the grille member against an inner side of the frame with the frame fitted flush to a surrounding surface in which the existing ventilation assembly is mounted.

The foregoing and other features and advantages will become more apparent from the following detailed description, which proceeds with reference to the accompanying figures.

DETAILED DESCRIPTION

Figure 1:
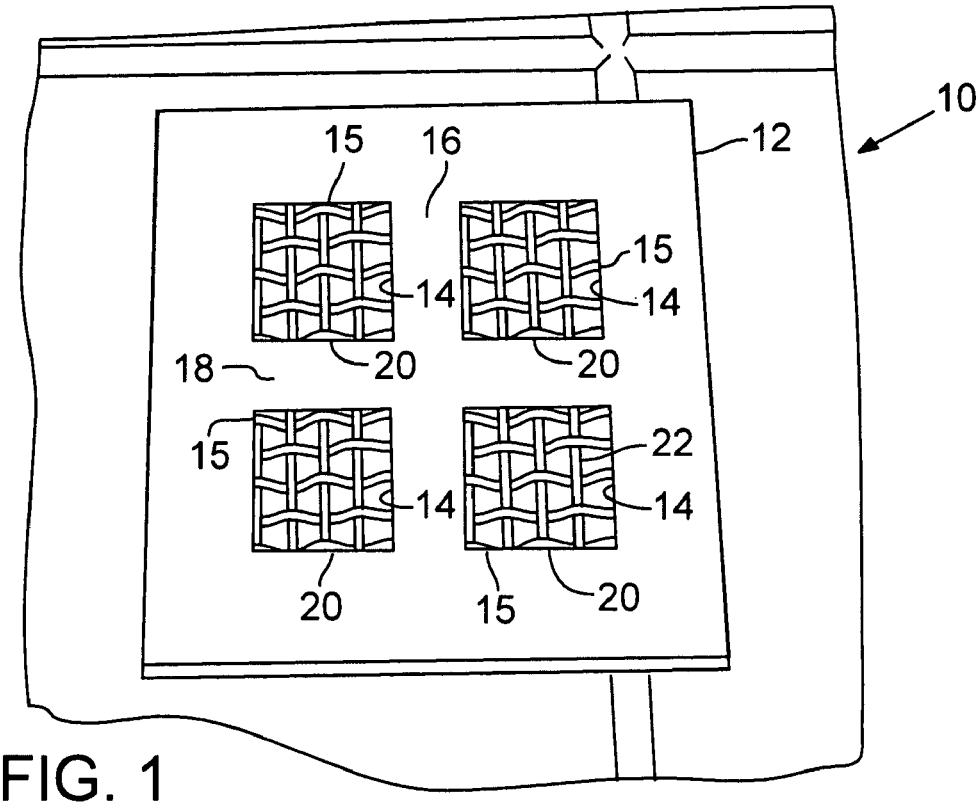
FIG. 1 PRIOR ART
FIG. 1 is a perspective view of a prior art ventilation assembly showing the fixed frame, its cross members and a grille member visible through open portions of the frame.

A conventional ventilation assembly 10, which has typically been used in security settings, e.g., jail cells, prison cells, holding cells, mental health facilities, etc. is shown in FIG. 1. The conventional ventilation assembly 10 was designed to provide ventilation to a cell, yet prevent a cell occupant from gaining access to the associated ventilation ductwork (not shown in the figures), such as in an effort to escape, to hide contraband or to exchange materials with occupants of other cells.

Referring to FIG. 1, the assembly 10 has a fixed frame 12 secured to an adjacent surface, which is usually a wall or a ceiling. The assembly 10 also includes a grille member 22, which is held in place by the fixed frame 12 and is visible in FIG. 1 through an inner venting area 14 defined in the fixed frame 12. Specifically, the inner venting area 14 is defined by inner edge(s) 15 of the fixed frame 12. For the specific example shown in FIG. 1, there are four inner edges 15 defining a generally rectangular inner venting area 14. The fixed frame 12 also includes first and second outer cross members 16, 18 that each span the inner venting area 14 and together define four open portions 20.

The assembly 10 suffers from several drawbacks. First, the configuration of the outer cross members 16, 18 provides a means for a cell occupant to hang himself. If the outer cross members are made of lighter material or a break-away construction such that they would fail before a hanging succeeded, then the cell occupant might gain access to the ventilation ductwork, which is also undesirable.

Second, the openings of the grille member 22 are relatively large, so an unsupervised cell occupant can push items through the grille member 22. Unintended items introduced into the ventilation system may cause damage if they enter components with moving parts or, in the case of food or other perishable material, may cause noxious odors to circulate through an entire facility. Removing debris from a ventilation system is time consuming and expensive.

According to a new approach, the ventilation assembly is fitted with a new outer frame from which a cell occupant cannot readily suspend his body weight. Thus, the new outer frame should reduce the chances that a cell occupant can hang himself or be hanged from the ventilation assembly. Also, the new frame can be fitted with a new grille member having openings that are too small to admit small items, yet still provides adequate open area to achieve the required number of ventilation air exchanges.

Figure 2:
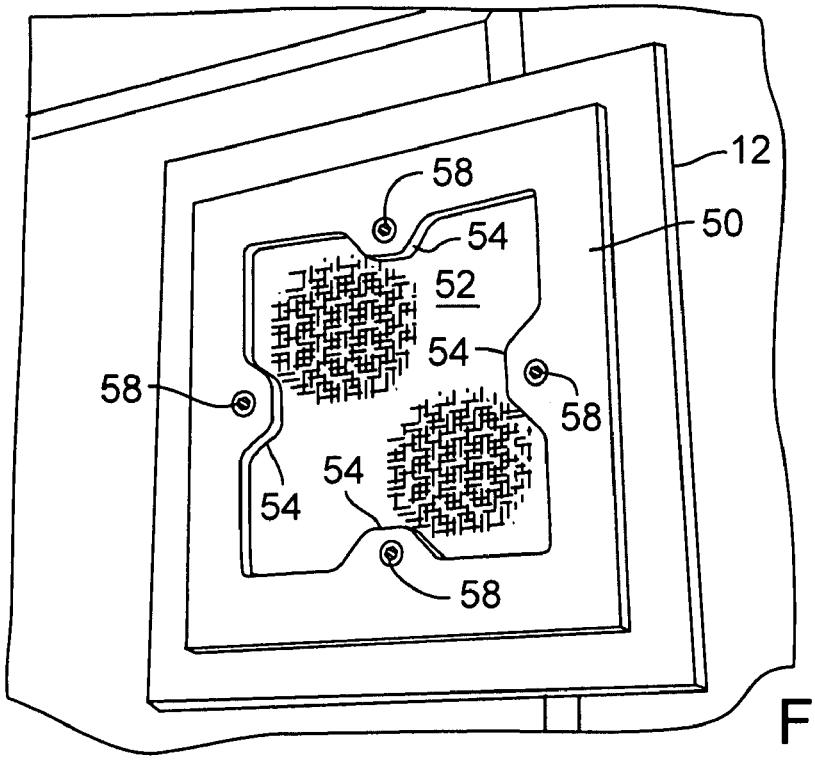
FIG. 2 is a perspective view of a new outer frame and new grille member attached to an existing fixed frame after it has been modified.
Figure 3:
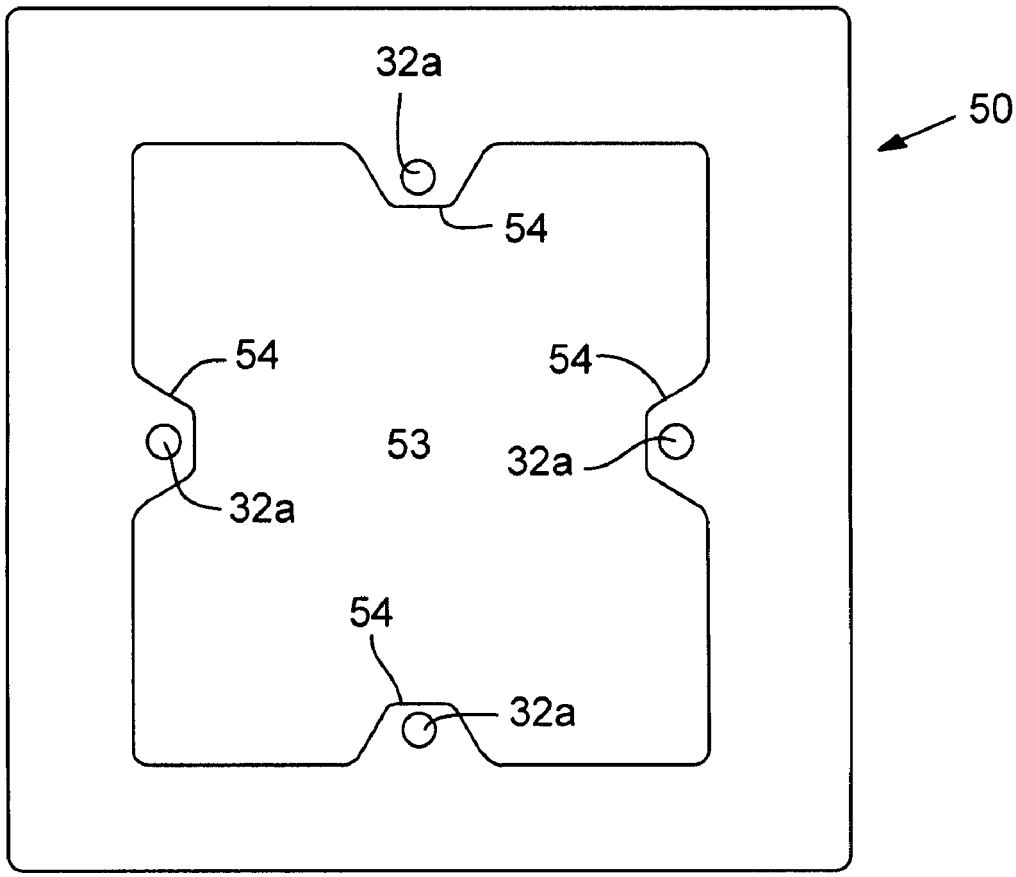
FIG. 3 is a plan view of the new outer frame.

FIG. 2 shows an exemplary embodiment of a new outer frame 50 and grille member 52, which are shown installed with the outer frame 50 fitted over the fixed frame 12 of the conventional ventilation assembly 10, modified as described below. As shown in FIG. 3, the outer frame 50 has an open inner venting area 53, i.e., an inner venting area that is substantially free of obstructions. The opening venting area 53 is free of structural elements that extend inwardly (whether they span the area 53 or are free at one end) and might support a cell occupant's body weight.

Figure 6:
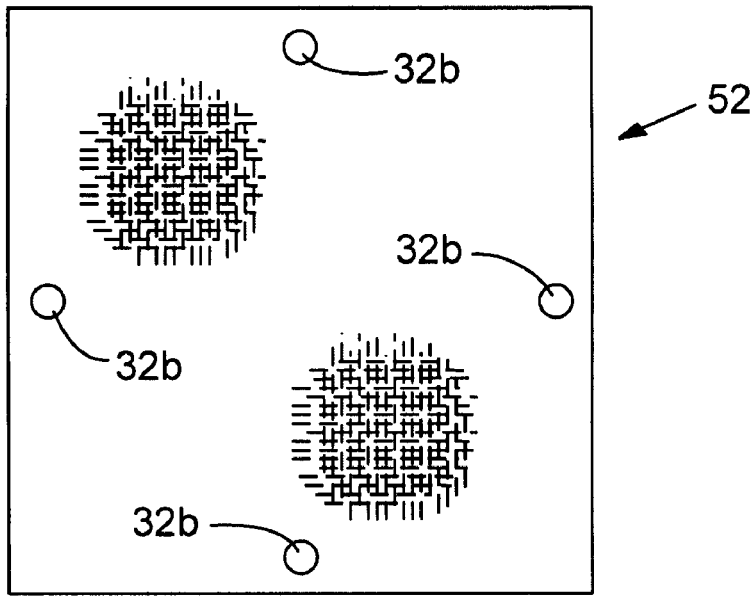
FIG. 6 is a plan view of the new grille member.

The grille member 52, which is also shown in FIG. 6, is preferably made of a mesh material with small openings, i.e., openings smaller than common items available to a cell occupant. For example, the average opening may be 5 mm or less, or in a more preferred implementation, 2 mm or less. In an especially preferred implementation, the average opening size or mean pore size is about 1 mm. Suitable materials include stainless steel mesh and other similar materials. In one implementation, the grille member 52 is made of Dynapore® Sintered Wire Mesh Multi-layered Laminate (Part No. 450330) having an average thickness of 0.375 in and an effective mean pore size of 1.00 mm. The porosity of this material exceeds the ventilating requirements for typical cells. For example, in the specific examples shown, the grille member 52 will allow flow of about 1100 cfm per sq ft. at 1 inch water column. As is understood by one of ordinary skill, the pressures and ventilation areas at any particular installation may dictate use of a material that allows more or less air flow.

The outer frame 50 and/or the grille member 52 can be provided as components of a new ventilation assembly, or one or both of these components can be retrofitted into an existing assembly. For retrofit installations, these components are sometime referred to as the "replacement" outer frame 50 and the "replacement" grille 52. Typically, many conventional ventilation assemblies have a fixed frame 12 that is permanently attached to the surrounding surface, such as being set into a concrete or cinder block wall, such that the fixed frame 12 cannot be removed without requiring substantial repair to that surface. Therefore, in some embodiments, components of the existing ventilation assembly are modified to allow use of the outer frame 50 and/or the grille member 52. The apertures 32*a* in the outer frame 50 can be formed in inwardly extending attachment portions 54. The attachment portions 54 have only a limited inwardly extending dimension and have curved or angled edges (as shown) tending to cause a rope, belt, strap of the like to slide off (even if one could be forced between the outer frame 50 and the secured grille member 52), thereby reducing the chance that a cell occupant could hang himself or be hanged from them.

Figure 7:
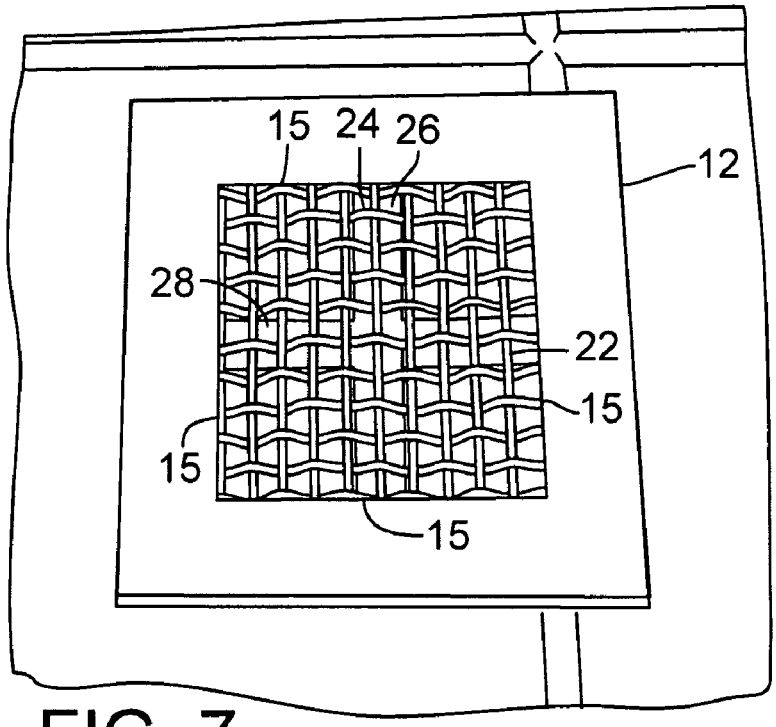
FIG. 7 Prior Art
FIG. 7 is a perspective view of a prior art ventilation assembly shown after an intermediate step in which the fixed frame has been modified by removing the cross members.
Figure 8:
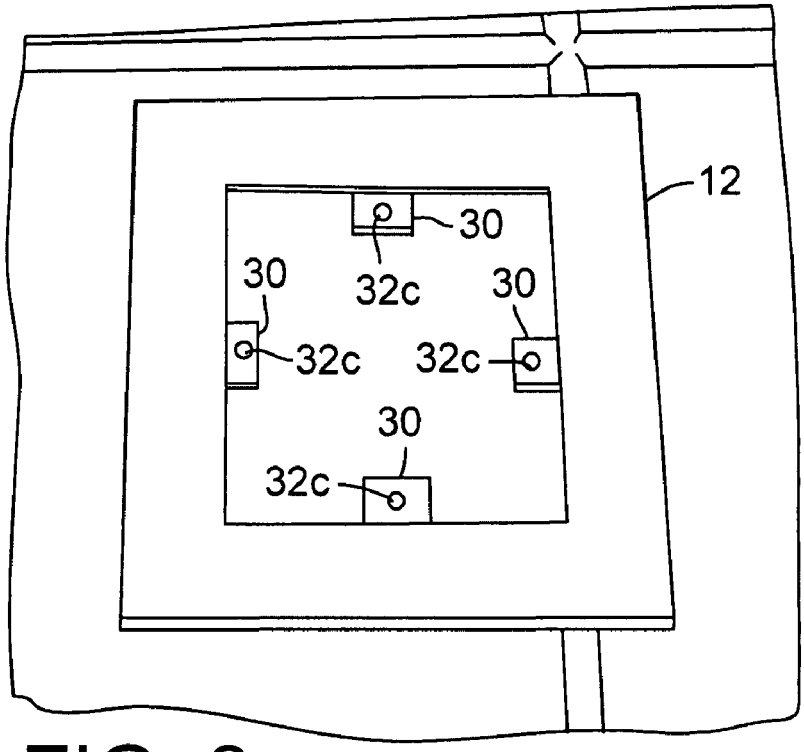
FIG. 8 is a perspective view similar to FIG. 7, except the existing grille member has been removed, a portion of each inner cross member has been removed, and remainder portions have been provided with holes for receiving fasteners.

For example, to retrofit the conventional ventilation assembly 10 shown in FIG. 1, the outer cross members 16, 18 are first removed, such as by use of a saw or other suitable method. Preferably, the cuts through the cross members 16,18 are aligned with the adjacent inner edge 15 such that the resulting modified venting area 14 is substantially rectangular (or square, as in this example) as shown in FIG. 7.

After the cross members 16, 18 are removed, the grille member 22 can be removed. In some cases, removal is facilitated by first cutting the grille member 22 into two pieces along a diagonal.

The conventional ventilation assembly 10 generally has an inner frame, which may have one or more inner cross members and may be a part of the fixed frame 12 as in the illustrated example. As shown in FIG. 7, behind the grille member 22, there is an inner frame 24 with inner cross members 26, 28. In this example, the inner cross members 26, 28 are generally aligned with the outer cross members 16, 18.

Conveniently, the inner frame 24 can be modified such that the new outer frame 50 can be attached to it. For example, the outer frame 50 can be attached to the inner frame 24 with fasteners. In the specific example shown in the drawings, portions of the inner cross members 26, 28 can be removed to leave remainder portions 30. The remainder portions 30 can be adapted to receive fasteners, such as by drilling apertures 32*c*. If desired, the apertures 32*c* can be tapped to provide threads.

Figure 4:
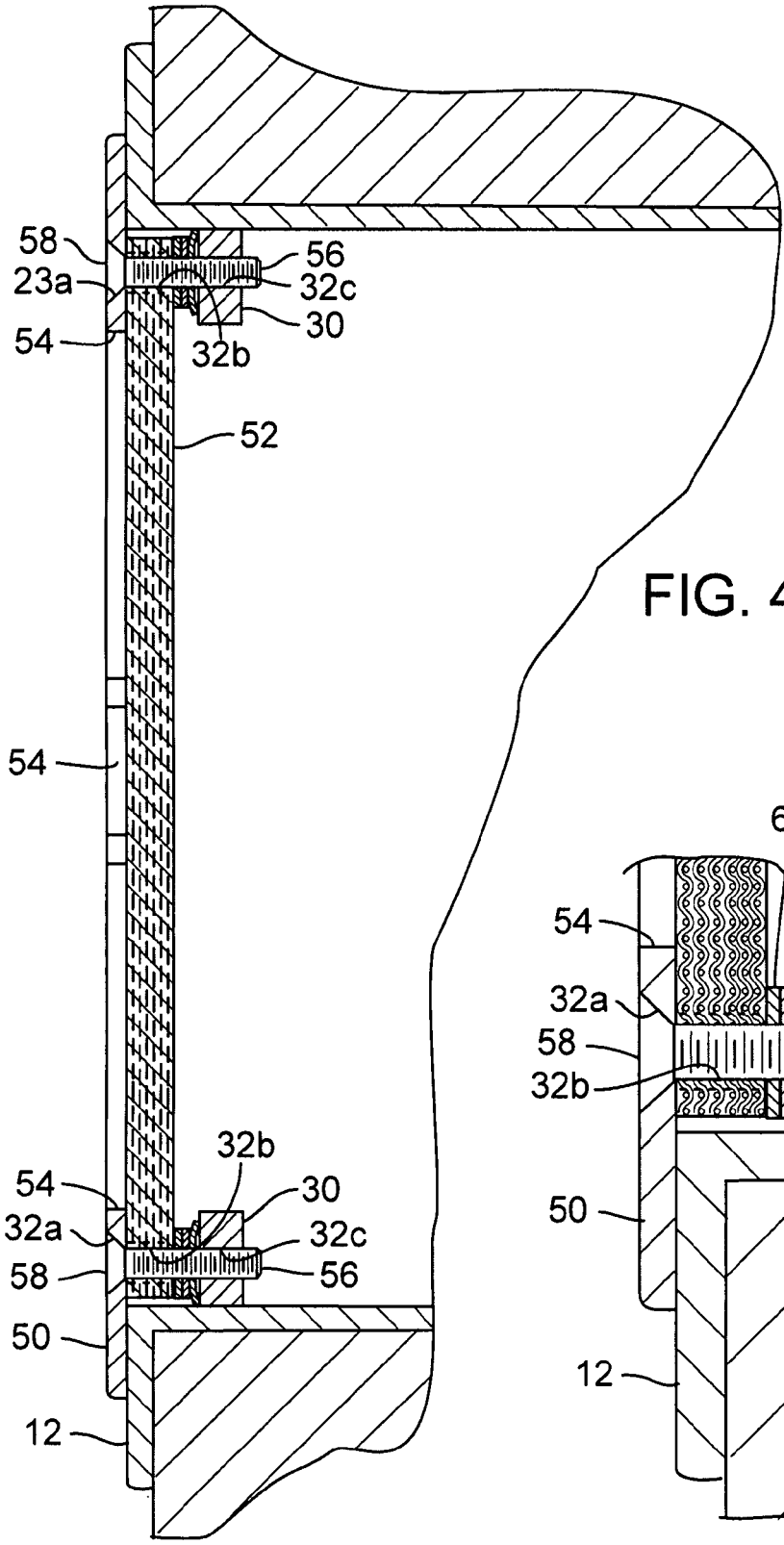
FIG. 4 is a side cross-sectional view showing the new outer frame and new grille as retrofitted over an existing modified fixed frame of a conventional ventilation assembly.
Figure 5:
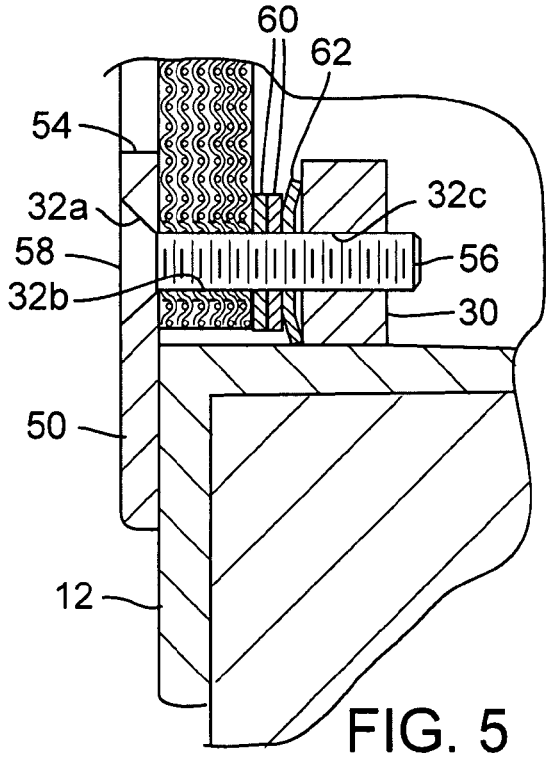
FIG. 5 is an enlarged cross-sectional view of a portion of FIG. 4 showing the attachment between the new outer frame and a modified inner frame of the conventional ventilation assembly.

The outer frame 50 can be used with the grille member 22, or, more desirably, with the new grille member 52. FIGS. 4 and 5 are cross sections showing the outer frame 50 and grille member 52 in an assembled state as installed in the modified conventional ventilation assembly. Fasteners 56 have been inserted through aligned apertures 32*a* in the outer frame 50 and 32*b* in the grille member 52, and threaded tight in the apertures 32*c* in the remainder portions 30. Thus, the outer frame 50 is secured in place, preferably flush, against the modified fixed frame 12.

Depending upon the relative dimensions of the conventional components vs. the replacement components, it may be desirable to ensure that the grille member 52 fits closely to an inner surface of the outer frame 50. In this way, it is would be more difficult to attempt to pry apart the assembly or otherwise gain access to the ductwork. For example, as best shown in FIG. 5, one or more washers or other spacers can be used to prevent a gap between the outer frame 50 and the grille member 52. As shown in FIG. 5, the grille member 52 may be thinner than the depth of the remainder portion 30 from the inner surface of the outer frame 50. In this example, two flat washers 60 and a rubber and steel crush washer 62 were inserted between the rear side of the grille member 52 and the remainder portions 30 before the fasteners 56 were tightened. After tightening, the grille member 52 was securely positioned close to the frame 50 with the crush washer 62 being deformed as shown.

The fasteners 56 may have tamper-resistant head portions 58, such as head portions that require a special tool. For example, in the illustrated examples, the head portions require use of a Torx® bit. Besides allowing for convenient and more cost-effective retrofit installations, use of fasteners to secure the grille 52 in place allows for easy replacement, should the grille 52 become damaged or require servicing.

In a specific embodiment, the outer frame is made from a 303 stainless steel in a 3/16 in thickness. Sharp edges were beveled, and the apertures 32*a* were countersunk. If desired, epoxy or another suitable material can be applied between the outer frame and the existing outer frame.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as our invention all that comes within the scope and spirit of these claims.

What is claimed is:

1. A method of retrofitting a ventilation assembly used in security settings, comprising:

providing an existing ventilation assembly having an existing fixed frame in which an existing opening having an existing venting area is defined and having at least one outer cross member spanning the existing venting area, an inner frame having an opening in which an inner venting area is defined and having at least one inner cross member spanning the existing venting opening, and a grille member positioned between the outer frame and the inner frame and generally aligned with each respective venting area;

removing the at least one outer cross member of the existing outer frame, thereby providing access to the grille member;

removing the existing grille member to provide access to the inner frame and inner cross member;

removing a portion of the at least one inner cross member and leaving at least one remaining portion;

providing a replacement outer frame having an opening that defines an open inner venting area not extending beyond the existing venting opening and being substantially free of obstructions;

providing a replacement grille member; and attaching the replacement outer frame to the inner frame at one or more points positioned to have axes extending through the existing venting opening and over a remaining portion of the existing fixed frame with the replacement grille member positioned between the replacement outer frame and the inner frame.

2. The method of claim 1, wherein removing the at least one outer cross member includes cutting the outer cross member at each end substantially flush with an adjacent inner edge(s) of the outer frame.

3. The method of claim 1, wherein the at least one outer cross member includes a first cross member and a second cross member arranged to intersect each other and to divide the inner venting area into four open portions.

4. The method of claim 1, wherein providing a replacement grille member includes providing a replacement grille member of a same type as the existing grille member.

5. The method of claim 1, wherein providing a replacement grille member includes providing a replacement grille member having a wire mesh construction with a mean pore size less than about 5 mm.

6. The method of claim 1, wherein providing a replacement grille member includes providing a replacement grille member made of a stainless steel material.

7. The method of claim 1, wherein the acts removing the at least one outer cross member and removing at least a portion of the inner cross member are carried out without removing the existing outer frame or the inner frame from the surrounding surface to which they are mounted.

8. The method of claim 1, wherein removing a portion of the at least one inner cross member includes cutting the inner cross member at each end at a distance spaced from an adjacent inner edge(s) of the inner frame, thereby defining the at least one remaining portion of the inner cross member.

9. The method of claim 8, wherein attaching the replacement outer frame to the inner frame includes connecting the replacement outer frame to the at least one remaining portion of the inner cross member.

10. The method of claim 9, further comprising providing holes in the remainder portions of the inner cross member, the holes being positioned to define the axes extending through the existing venting area, the holes being configured to receive fasteners for connecting the replacement outer frame to the inner frame.

11. The method of claim 1, wherein attaching the replacement outer frame to the inner frame includes connecting the replacement outer frame to the inner frame with tamper-resistant fasteners.

12. The method of claim 1, wherein providing a replacement outer frame that defines an open inner venting area substantially free of obstructions comprises providing a replacement outer frame free of any projection of substantial length extending from an inner edge.

13. A retrofit grille frame assembly for retrofitting an existing ventilation assembly used in security settings, comprising:

a frame having an outer periphery sized larger than an existing opening defined for the existing ventilation assembly;

the frame having at least one inner edge defining a vent opening in the frame not extending beyond the existing opening, the vent opening being free of any projection of substantial length extending inwardly from any inner edge;

the frame having a grille member receiving portion defined on an inner side for receiving a grille member and retaining the grille member in place when the frame is installed;

a grille member made of a mesh laminate material and sized to be received in the grille member receiving portion and larger than the vent opening;

the frame having at least one attachment portion capable of receiving a fastener for attaching the frame and the grille member to a portion of the existing ventilation assembly, the attachment portion defining an attachment axis positioned to extend through the existing opening.

14. The frame assembly of claim 13, wherein the frame has four inner edges defining a generally rectangular vent opening and four attachment portions, each of the attachment portions being spaced approximately midway along a respective one of the inner edges and extending inwardly.

15. The frame assembly of claim 13, wherein the grille member is made of a sintered mesh laminate.

16. The frame assembly of claim 13, wherein the mesh laminate material has a mean pore size of less than about 5 mm.

17. The frame assembly of claim 13, wherein the mesh laminate material has a mean pore size of less than about 2 mm.

18. The frame assembly of claim 13, wherein the mesh laminate material has a mean pore size of about 1 mm.

19. The frame assembly of claim 13, wherein the attachment portion includes an aperture, further comprising at least one fastener having a tamper resistant head portion and configured to extend through the aperture in the attachment portion and a corresponding aperture in a grille member, the fastener having a remaining length sufficient to allow attachment to the portion of the existing ventilation assembly and to accommodate at least one washer to achieve a tight fit of the grille member against an inner side of the frame with the frame fitted flush to a surrounding surface in which the existing ventilation assembly is mounted.

20. The frame assembly of claim 14, wherein the attachment portions project away from the respective inner edges of the frame and toward a center of the vent opening, each of the attachment portions being configured to have curved or angled edges.

21. The frame assembly of claim 13, wherein the portion of the existing ventilation assembly to which the fastener is attached comprises a tab projecting inwardly from an inner surface defining the existing ventilation opening.

* * * * *